US009909225B2

(12) United States Patent
Lee et al.

(10) Patent No.: US 9,909,225 B2
(45) Date of Patent: Mar. 6, 2018

(54) PZT AMORPHOUS ALLOY PLATING SOLUTION AND METHOD FOR PLATING A PZT AMORPHOUS ALLOY USING THE SAME

(71) Applicant: BEFS CO., LTD., Seoul (KR)

(72) Inventors: Seungjin Lee, Yongin (KR); Changhyeok Bang, Seoul (KR); Daeyeong Yun, Seoul (KR)

(73) Assignee: BEFS CO., LTD., Seoul (KR)

( * ) Notice: Subject to any disclaimer, the term of this patent is extended or adjusted under 35 U.S.C. 154(b) by 0 days.

(21) Appl. No.: 15/168,061

(22) Filed: May 29, 2016

(65) Prior Publication Data

US 2017/0260640 A1 Sep. 14, 2017

(30) Foreign Application Priority Data

Mar. 11, 2016 (KR) ..... 10-2016-0029269

(51) Int. Cl.

| | |
|---|---|
| ***C23C 16/40*** | (2006.01) |
| ***C03C 17/27*** | (2006.01) |
| ***C25D 3/56*** | (2006.01) |
| ***C23C 18/16*** | (2006.01) |
| ***C23C 18/48*** | (2006.01) |

(52) U.S. Cl.

CPC ..... *C25D 3/56* (2013.01); *C23C 18/1633* (2013.01); *C23C 18/48* (2013.01)

(58) Field of Classification Search

CPC ... C25D 3/22; C25D 3/34; C25D 3/56; C25D 3/60

USPC ..... 205/238, 244, 252; 106/1.25, 1.29

See application file for complete search history.

(56) References Cited

U.S. PATENT DOCUMENTS

| | | | | |
|---|---|---|---|---|
| 4,229,218 | A | 10/1980 | Gulla et al. | |
| 5,342,648 | A | 8/1994 | MacKenzie et al. | |
| 5,462,647 | A * | 10/1995 | Bhattacharya | C01G 25/006 205/557 |
| 2003/0108664 | A1 * | 6/2003 | Kodas | C09D 11/30 427/125 |

FOREIGN PATENT DOCUMENTS

| | | |
|---|---|---|
| JP | 2000-397409 | 10/2002 |
| KR | 10-2003-7003849 | 6/2003 |
| KR | 10-2002-0077185 | 7/2003 |
| KR | 10-2007-0063431 | 1/2008 |
| KR | 10-2012-0088709 | 1/2013 |
| NP | 2012-220472 | 4/2014 |

OTHER PUBLICATIONS

Ma et al., "Electrophoretic Deposition of Lead Zirconate Titanate Ceramics," J. Am. Ceram. Soc. (no month, 2002), vol. 85, No. 7, pp. 1735-1737.*

Malic et al., Homogeneity of Pb(Zr, Ti)O3 Thin Films by Chemical Solution Deposition: Extended X-ray Absorption Fine Structure Spectroscopy Study of Zirconium Local Environment, Sep. 2006, J. Appl. Phys. 100, pp. 051612-1-051612-8, American Physics Institute.

* cited by examiner

*Primary Examiner* — Edna Wong

(74) *Attorney, Agent, or Firm* — STIP Law Group, LLC

(57) ABSTRACT

The present invention relates to the lead-zirconate-titanate (PZT) amorphous alloy plating solution which may be used to form a PZT amorphous alloy film having excellent mechanical and physical properties and a method for plating a PZT amorphous alloy using the same. The PZT amorphous alloy plating solution may include a Pb precursor, a Zr precursor, and a Ti precursor. 10~50 parts by weight of the Zr precursor and 5~30 parts by weight of the Ti precursor may be included based on 100 parts by weight of the Pb precursor. Accordingly, electrical conductivity can be improved because the PZT amorphous alloy plating solution has a structure which has low crystallinity or which is amorphous. Furthermore, excellent electrical characteristics can be achieved because the PZT amorphous alloy plating solution has excellent conductivity or chemical stability.

6 Claims, No Drawings

PZT AMORPHOUS ALLOY PLATING SOLUTION AND METHOD FOR PLATING A PZT AMORPHOUS ALLOY USING THE SAME

CROSS REFERENCE TO RELATED APPLICATION

The present application claims the benefit of Korean Patent Application No. 10-2016-0029269 filed in the Korean Intellectual Property Office on Mar. 11, 2016, the entire contents of which are incorporated herein by reference.

BACKGROUND OF THE INVENTION

1. Technical Field

The present invention relates to a lead-zirconate-titanate (PZT) amorphous alloy plating solution which may be used to form a PZT amorphous alloy film having excellent mechanical and physical properties and a method for plating a PZT amorphous alloy using the same.

2. Description of the Related Art

In general, lead-zirconate-titanate (PZT)-series oxide ceramics has an empirical composition of $Pb_{1+x}(Zr_yTi_{1-x})O_3$, and is widely used in various fields in a film form in addition to a bulk form because it has electrically excellent piezoelectric physical properties, an excellent ferroelectric property, and a pyroelectric property. More specifically, recently, in fabricating sensors and actuators using an MEMS technology complying with needs for a minimum size and integration of electro-mechanical complex parts, there is a growing interest in a PZT-series thin film and thick film having advantages of high sensitivity, high output, and a fast response speed.

The PZT-series oxide ceramics have a piezoelectric characteristic when it is used to form a perovskite structure represented as $ABO_3$. The perovskite structure can be obtained only when stochiometry is accurately matched. In general, lead (Pd) tends to become relatively easily volatile due to a low melting point. Accordingly, when PZT-series oxide ceramics having a perovskite structure are fabricated, excessive Pb of 10-50% is further added to the PZT-series oxide ceramics in order to maintain stochiometry by taking into consideration the low melting point. If such excessive Pb is not fully consumed, but is locally present on Pb or PbO within the PZT-series oxide ceramics, however, it functions as a major cause to lower a breakdown voltage or to deteriorate dielectric/piezoelectric characteristics.

Furthermore, in a perovskite crystal structure in which the PZT-series oxide ceramics represents the piezoelectric characteristics, the stochiometry ratio of x and y in $Pb_x(Zr_yTi_{1-y})O_3$ needs to have a range of $1 \leq x \leq 1.3$, $0.1 \leq y \leq 0.9$. In this case, if a composition of Pb is less than 1, the perovskite crystal structure is not formed, but a flourite or pyrochore crystal structure is formed. Accordingly, the asymmetry of B-sites is lost, and thus the piezoelectric characteristics are not obtained.

However, PZT oxide ceramics having a crystal structure, such as the perovskite, flourite or pyrochore crystal structure, is problematic in that electrical conductivity is low because crystallinity is high.

Korean Patent No. 0504609 (Aug. 3, 2005) proposes a method for fabricating a PZT thin film through chemical vapor deposition (CVD) using a combination of $Pb(dpm)_2$-$Zr(OiPr)(dpm)_3$-$Ti(OiPr)_2(dpm)_2$ as a material for gasifying a solution.

However, the prior art is a method for fabricating PZT having a perovskite structure and is problematic in that electrical conductivity because crystallinity is high.

PRIOR ART DOCUMENT

[Patent Document]

(Patent Document 1) Korean Patent No. 0504609 (Aug. 3, 2005)

SUMMARY OF THE INVENTION

An object of the present invention is to propose a PZT amorphous alloy plating solution which may be used to fabricate amorphous PZT oxide ceramics not having a crystalline microstructure by simultaneously separating lead, zirconium, and titanium included in a plating solution which includes a Pb precursor, a Zr precursor, and a Ti precursor using a plating solution and a method for plating a PZT amorphous alloy using the PZT amorphous alloy plating solution.

In an embodiment of the present invention, a lead-zirconate-titanate (PZT) amorphous alloy plating solution includes a Pb precursor, a Zr precursor, and a Ti precursor. 10~50 parts by weight of the Zr precursor and 5~30 parts by weight of the Ti precursor are included based on 100 parts by weight of the Pb precursor.

The PZT amorphous alloy plating solution may further include at least one of a reducing agent, a complexing agent, a stabilizer, an organic acid, and an amide-series compound. The reducing agent may include a phenolic-series compound represented by Chemical Formula below.

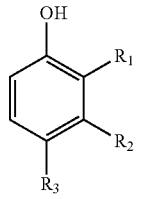

In Chemical Formula above, R1~R3 denote a hydrogen atom, a hydroxy group, a carboxyl group, and an alkyl group having a carbon number of 1 to 4 on a straight chain or a branch.

In another embodiment of the present invention, a method for plating a lead-zirconate-titanate (PZT) amorphous alloy includes preparing a PZT amorphous alloy plating solution including a Pb precursor, a Zr precursor, and a Ti precursor and dipping an electrode into the prepared PZT amorphous alloy plating solution and performing plating using an electric current.

After performing the plating, the method may further include discoloring, by the PZT amorphous alloy plating solution, when a concentration of lead, zirconium, and titanium included in the PZT amorphous alloy plating solution becomes a specific concentration or less and supplementing the PZT amorphous alloy plating solution with the Pb precursor, the Zr precursor, and the Ti precursor.

Preparing the PZT amorphous alloy plating solution may include fabricating a metal powder aqueous solution may further include a sulfuric acid in the Pb precursor, the Zr precursor, and the Ti precursor and including at least one of a group consisting of a reducing agent, a complexing agent, a stabilizer, an organic acid, and an amide-series compound in the metal powder aqueous solution and mixing the at least one and the metal powder aqueous solution.

Fabricating the metal powder aqueous solution may include fabricating the metal powder aqueous solution by further including a sulfuric acid in 10~50 parts by weight of the Zr precursor and 5~30 parts by weight of the Ti precursor of based on 100 parts by weight of the Pb precursor. The reducing agent may include a phenolic-series compound represented by Chemical Formula below.

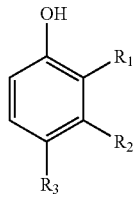

In Chemical Formula above, R1~R3 denote a hydrogen atom, a hydroxy group, a carboxyl group, and an alkyl group having a carbon number of 1 to 4 on a straight chain or a branch.

Performing the plating may include performing the plating using an electric current density of 3~20.0 A/dm$^2$ at a temperature of 10~30° C.

DETAILED DESCRIPTION

Hereinafter, some embodiments of the present invention are described in detail with reference to the accompanying drawings. Prior to the description, terms or words used in this specification and the claims should not be limitedly interpreted as having common meanings or those found in dictionaries, but should be interpreted as having meanings and concepts which comply with the technical spirit of the present invention.

In the entire specification, unless explicitly described to the contrary, the word "include, have, or comprise" will be understood to imply the inclusion of stated elements but not the exclusion of any other elements.

In each of steps, symbols are used for convenience of description, and the symbols do not describe order of the steps. The steps may be performed in order different from order described in the context unless specific order is clearly described in the context. That is, the steps may be performed according to described order, may be performed substantially at the same time, or may be performed in reverse order.

Unless specially mentioned otherwise, the term "amorphous" means that the crystals of an alloy including two or more metal elements are irregularly arranged and thus do not have a crystalline microstructure.

A lead-zirconium-titanium (PZT) amorphous alloy plating solution and a method for plating a PZT amorphous alloy using the same according to embodiments of the present invention are described in detail below.

The PZT amorphous alloy plating solution according to an embodiment of the present invention includes a Pb precursor, a Zr precursor, and a Ti precursor, and may include 10~50 parts by weight of the Zr precursor and 5~30 parts by weight of the Ti precursor based on 100 parts by weight of the Pb precursor.

The PZT amorphous alloy plating solution may include zirconium of 0.6~0.4 mole used in the Zr precursor and titanium of 0.7~0.3 mol used in the Ti precursor for every lead (Pb) of 1 mole included in the Pb precursor.

A hydroxide compound (lead hydroxide, zirconium hydroxide, titanium hydroxide) or oxide (lead oxide, zirconium oxide, titanium oxide) may be used as the Pb precursor, the Zr precursor, and the Ti precursor, but any compound may be used as the Pb precursor, the Zr precursor, and the Ti precursor if the compound includes lead, zirconium, and titanium metal ions without being limited to a specific compound.

The PZT amorphous alloy plating solution may further include at least one of a reducing agent, a complexing agent, a stabilizer, an organic acid, and an amide-series compound. More specifically, in order to plate lead, zirconium, and titanium included in the PZT amorphous alloy plating solution at the same time in an amorphous manner, the reducing agent is used to secure a high covering power using a chemical reduction and an electrical reduction at the same time because it is difficult to obtain amorphous plating having a high covering power and high quality using a pure electrical reducing power.

The reducing agent may include a phenolic compound of Chemical Formula 1 below.

(1)

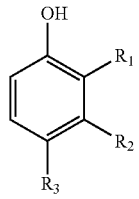

In Chemical Formula 1, R1~R3 denote a hydrogen atom, a hydroxy group, a carboxyl group, and an alkyl group having a carbon number of 1 to 4 on a straight chain or a branch.

The phenol-series compound represented by Chemical Formula 1 may include at least one of the group consisting of phenol, o-cresol, p-cresol, o-ethylphenol, p-ethylphenol, t-butylphenol, hydroquinone, catechol, pyrogallol, and methyl hydroquinone.

Furthermore, a compound of an oxidized or reduced form of the phenol-series compound represented by Chemical Formula 1 may also be used as a reducing agent. The reducing agent has a clear color change depending on its oxidized or reduced form. Accordingly, in order to determine whether lead, zirconium, and titanium consumed during a plating process has been supplemented or not, a concentration level of plating metal within the PZT amorphous alloy plating solution can be checked without regularly measuring a concentration by changing the color of the PZT amorphous alloy plating solution if lead, zirconium, and titanium become a specific concentration or less. Accordingly, the reducing agent may help to reduce a worker's work load and may help a worker to manage a concentration of plating metal included in a plating solution regardless of a competence level.

The phenol-series compound represented by Chemical Formula 1 may be included 0.1~10 ml/L for each plating solution 1 L. If the phenolic-series compound is less than 0.1 ml/L, a change in the color of the PZT amorphous alloy plating solution is not clear in a specific concentration or less of plating metal within the PZT amorphous alloy plating solution because content within the PZT amorphous alloy plating solution is not sufficient. This makes it difficult for a worker to determine whether or not to supplement the plating metal. If the phenolic-series compound exceeds 10 ml/L, the chemical stability of the PZT amorphous alloy plating solution cannot be secured.

When a plating process is performed using a reducing agent, such as that of Chemical Formula 1, plating metal included in the PZT amorphous alloy plating solution is gradually consumed. If a concentration of the plating metal is reduced, electrons discharged through an electrode reduce the oxidized reducing agent within the PZT amorphous alloy plating solution, thereby being capable of changing the color of the PZT amorphous alloy plating solution.

Accordingly, a worker may visually recognize that a concentration of a plating removing component within the PZT amorphous alloy plating solution has been reduced through a change in the color of the PZT amorphous alloy plating solution, and may supplement the plating metal within the PZT amorphous alloy plating solution. Accordingly, the reducing agent is oxidized while emitting electrons due to its property that reduces a counterpart material while it is oxidized. Accordingly, the color of the PZT amorphous alloy plating solution may return to its original color prior to the change.

Such a series of processes may continue to be repeatedly generated depending on a concentration of the plating metal within the PZT amorphous alloy plating solution. Accordingly, when the plating process is performed, workability can be improved because a worker can visually recognize a change in the concentration of the plating metal within the PZT amorphous alloy plating solution. Furthermore, quality of plating can be uniformly managed by continuously managing a concentration of the plating metal within the PZT amorphous alloy plating solution.

In general, the amorphous alloy plating solution according to an embodiment of the present invention is a plating solution used for a process for amorphous alloy plating, and may be used for an electrolysis plating process and a non-electrolysis plating process.

A DL-tartaric acid, a citric acid, citric acid sodium, citric acid potassium, a citric acid, and ammonium may be used as the complexing agent.

The stabilizer is used to stabilize the PZT amorphous alloy plating solution or to prevent the dissolution of the PZT amorphous alloy plating solution. A sulfur-containing compound, an oxycarboxylic acid, a nitrogenous compound, a cyanide compound, or a boron-series compound may be used as the stabilizer.

Any amide-series compound may be used as the amide-series compound if it includes amide. If the amide-series compound is used, a separation speed can be enhanced during a plating process, the external appearance and attachment of plating can be improved, and the chemical stability of the PZT amorphous alloy plating solution can be improved. Accordingly, there is an advantage in that stiffness can be improved because the internal stress of a plating layer is effectively reduced.

An aliphatic amide-series compound, such as dimethylformamide, N,N-dimethylaceteamide, alkoxy-N-isopropylpropionamide, or hydroxyalkylamide, or an alicyclic amide-series compound, such as N-methyl-2-pyrrolidine or N-ethyl-pyrrolidine, may be used as the amide-series compound.

For example, the lead-zirconium-titanium (PZT) amorphous alloy plating solution may further include a fluoroboric acid, boron, and gelatine, that is, a stabilizer, in addition to lead, titanium, zirconium, and the reducing agent represented by Chemical Formula 1. The PZT amorphous alloy plating solution may include 1~3 parts by weight of gelatine and 1~10 parts by weight of the reducing agent based on 100 parts by weight of the fluoroboric acid. Boron assists the role of the stabilizer and the reducing agent and may include to the extent that it is saturated.

The amorphous alloy plating solution according to an embodiment of the present invention may further include a pH control agent in addition to the aforementioned components. For example, a sulfuric acid or a hydrochloric acid may be selected as the pH control agent. Furthermore, by adding the pH control agent, the amorphous alloy plating solution according to an embodiment of the invention present may have pH 0.1~4, for example. Furthermore, the PZT amorphous alloy plating solution according to an embodiment of the present invention may further include an additional component depending on a plating method.

A method for plating a PZT amorphous alloy according to an embodiment of the present invention may be performed using a common electrolysis or electroless plating process, and may include any method if the method is performed using the PZT amorphous alloy plating solution according to an embodiment of the present invention.

For example, the method for plating a PZT amorphous alloy may be performed using an electroplating (electrolysis plating) process. In this case, a common electrolysis plating process may be used, but the plating of a PZT amorphous alloy may be performed by inputting the PZT amorphous alloy plating solution according to an embodiment of the present invention to a plating bath.

More specifically, the plating of the PZT amorphous alloy may be performed by preparing the PZT amorphous alloy plating solution including at least one of the group consisting of the reducing agent, the complexing agent, the stabilizer, the organic acid, and the amide-series compound in the Pb precursor, the Zr precursor, and the Ti precursor, dipping an electrode into the prepared PZT amorphous alloy plating solution, and plating the PZT amorphous alloy using an electric current.

After the plating, when a concentration of lead, zirconium, and titanium included in the PZT amorphous alloy plating solution becomes a specific concentration or less, the color of the PZT amorphous alloy plating solution may be changed, and the PZT amorphous alloy plating solution may be supplemented with the Pb precursor, the Zr precursor, and the Ti precursor.

A change in the color of the PZT amorphous alloy plating solution is for enabling a worker to visually recognize that a concentration of lead, zirconium, and titanium included in the PZT amorphous alloy plating solution has been changed. If the PZT amorphous alloy plating solution is supplemented with the Pb precursor, the Zr precursor, and the Ti precursor, the reducing agent is oxidized while emitting electrons due to its property that reduces a counterpart material while it is oxidized. Accordingly, the color of the PZT amorphous alloy plating solution may return to its original color prior to the change.

A change in the color of the PZT amorphous alloy plating solution means a change from "color" to "colorlessness", a change from "colorlessness" to "color", or a change from "color" to "another color."

Preparing the PZT amorphous alloy plating solution may include fabricating a metal powder aqueous solution including a sulfuric acid in the Pb precursor, the Zr precursor, and the Ti precursor, and mixing at least one of the group consisting of the reducing agent, the complexing agent, the stabilizer, the organic acid, and the amide-series compound with the aqueous solution.

Fabricating the metal powder aqueous solution may include fabricating the metal powder aqueous solution by making a metal precursor of a powder form, for example, lead hydroxide, zirconium hydroxide, and titanium hydroxide, that is, a hydroxy metal compound combined with an —OH group, react with a sulfuric acid so that the metal powder aqueous solution can remain stable in the ion state in water.

The PZT amorphous alloy plating solution may be prepared by further including at least one of the group consisting of the reducing agent, the complexing agent, the stabilizer, the organic acid, and the amide-series compound in the fabricated metal powder aqueous solution and uniformly mixing them.

A detailed composition and characteristics of the PZT amorphous alloy plating solution have been described above, and thus a description thereof is omitted.

More specifically, the PZT metal powder aqueous solution is fabricated by making lead hydroxide, titanium hydroxide, and zirconium hydroxide combined with an —OH group react with the sulfuric acid so that the hydroxides can easily dissolve in water and can be stably present in the ion state.

A mixing ratio of the lead hydroxide, titanium hydroxide, and zirconium hydroxide may include 10~50 parts by weight of the zirconium hydroxide and 5~25 parts by weight of the titanium hydroxide based on 100 parts by weight of the lead hydroxide (Pb). If the mixing ratio is exceeded, the stiffness of a PZT alloy may be reduced or a plating process may not be properly performed due to the electrical conductivity of each of lead, zirconium, and titanium. Furthermore, water content included in the lead hydroxide, zirconium hydroxide, titanium hydroxide may be 70~85 wt % for quality of a plating layer.

The PZT amorphous alloy plating solution according to an embodiment of the present invention may be fabricated by further including a fluoroboric acid, boron, and gelatine, that is, a stabilizer and an organic acid, in the compound represented by Chemical Formula 1, that is, the reducing agent, in the metal powder aqueous solution.

Performing the plating of the PZT amorphous alloy using an electric current after dipping the electrode into the prepared PZT amorphous alloy plating solution may include the plating on condition of a temperature of 10~30° C. and an electric current density of 3~20.0 A/dm$^2$. If such a range is exceeded, a PZT alloy having a crystalline structure may be plated, or plating quality may be reduced because lead, zirconium, and titanium are not uniformly plated.

If a concentration of plating metal within the PZT amorphous alloy plating solution becomes a specific concentration or less during the plating, the color of the PZT amorphous alloy plating solution may be changed because the electrons discharged through the electrode reduces the oxidized reducing agent within the PZT amorphous alloy plating solution. Accordingly, a worker visually recognizes that a concentration of the plating metal within the PZT amorphous alloy plating solution has been reduced based on a change in the color of the PZT amorphous alloy plating solution, and supplements the PZT amorphous alloy plating solution with the plating metal. Accordingly, the reducing agent is oxidized while emitting electrons due to its property that reduces a counterpart material while it is oxidized. Accordingly, the color of the PZT amorphous alloy plating solution may return to its original color prior to the change.

Such discoloring and supplementation continue to be repeatedly performed depending on a concentration of plating metal within the PZT amorphous alloy plating solution. As a result, when the plating process is performed, a worker may visually recognize a change in the concentration of plating metal within the PZT amorphous alloy plating solution and manage the concentration. Accordingly, workability can be improved, and uniform quality of alloy plating can be secured by continuously managing a concentration of plating metal within the PZT amorphous alloy plating solution.

Furthermore, in an embodiment of the present invention, an object to be plated, that is, the subject of plating, is not limited. The object to be plated is an object of plating or alloy plating through the PZT amorphous alloy plating solution according to an embodiment of the present invention, and includes semimanufactured goods, finished goods, and a constituent material for fabricating the semimanufactured goods and the finished goods. The object to be plated may be single metal, such as aluminum (Al), magnesium (Mg), iron (Fe), or copper (Cu), or an alloy including one or more pieces of metal selected from aluminum (Al), magnesium (Mg), iron (Fe), or copper (Cu), for example. For example, the object to be plated may be a plastic material.

Furthermore, an embodiment of the present invention may be applied to a decoration process for common products or a minute precision process. For example, an embodiment of the present invention may be used to form a three-dimensional structure or a micro (or nano) pattern in the LIGA process of MEMS and is not specially limited to a specific field.

As described above, in accordance with an embodiment of the present invention, stress within a plating layer can be significantly reduced by the amide-series compound. Furthermore, a high-quality plating surface can be obtained because the surface stiffness of the plating layer is increased.

An embodiment of the present invention is described below. However, the category of the present invention is not limited to the following embodiment, and those skilled in the art may modify the described contents in various forms without departing from the scope of the present invention.

Embodiment 1

Process for Plating Lead-Titanium-Zirconium (PZT) Alloy

The metal powder aqueous solution was prepared by making a sulfuric acid react with lead hydroxide (Pb) 100 g (water content 75.45%), zirconium hydroxide 32.03 g (water content 79.68%), and titanium hydroxide 16.67 g (water content 82.94%) so that the metal powder aqueous solution could easily dissolve in water and could be present in an ion state. A fluoroboric acid 100 g, hydroquinone 5 g, and gelatine 0.2 g was mixed with the prepared metal powder aqueous solution, and boron was inputted to the mixture so that boron was saturated. The mixture was mixed with the metal powder aqueous solution, thereby fabricating the PZT amorphous alloy plating solution.

The fabricated PZT amorphous alloy plating solution was put in a plating bath, and plating was performed by applying an electric current of 7.0 A/dm$^2$ to pH 0.9, a positive pole (sn 10%, Pb 90% Vinyon bag) at normal temperature of 25° C.

The fabricated PZT amorphous alloy plating solution was first colorless, but became colored (red) because hydroquinone having a strong reducing agent property generated quinone through an oxidation-reduction reaction.

An alloy was uniformly plated on one side of the positive pole. As time gradually goes by, the PZT amorphous alloy plating solution was checked to become transparent from the color (red). The PZT amorphous alloy plating solution was supplemented with the metal alloy compound with which lead hydroxide, zirconium hydroxide, and titanium hydroxide having a sulfuric acid reacted therewith was mixed.

When the metal alloy compound is supplemented, it was found that the PZT amorphous alloy plating solution became colored (red) again.

After the plating process was finished, an amorphous structure having a composition of Pb:Zr:Ti=1.0:0.52:0.48 was found as the results of the measurement of a plating layer plated on an electrode using XRD (e.g., an X-ray diffraction analysis method or X-ray diffraction spectroscopy) and a scanning electron microscope (SEM).

Accordingly, when a plating process is performed using the PZT amorphous alloy plating solution according to an embodiment of the present invention, an amorphous PZT alloy not having a perovskite, flourite or pyrochore crystal structure can be plated. Furthermore, a change in the concentration of plating metal to be plated visually appears according to a change in the color of the PZT amorphous alloy plating solution as a concentration of the plating metal is reduced during the plating process. This helps a worker to supplement the plating metal within a rapid time. Accordingly, a concentration of a metal component included in the PZT amorphous alloy plating solution can be effectively managed.

The present invention relates to the lead-zirconate-titanate (PZT) amorphous alloy plating solution which may be used to form a PZT amorphous alloy film having excellent mechanical and physical properties and a method for plating a PZT amorphous alloy using the same. Electrical conductivity can be improved because the PZT amorphous alloy plating solution has a structure which has low crystallinity or which is amorphous. Furthermore, excellent electrical characteristics can be achieved because the PZT amorphous alloy plating solution has excellent conductivity or chemical stability.

Furthermore, if the reducing agent having a clear color change is further included in the PZT amorphous alloy plating solution depending on an oxidized or reduced form, when a concentration of lead, zirconium, and titanium consumed during a plating process becomes a specific concentration or less, the color of the PZT amorphous alloy plating solution is changed, and whether or not to supplement plating metal can be determined in real time based on a change in the color of the PZT amorphous alloy plating solution. Accordingly, a variation in quality of a plating layer can be reduced because the precision and reliability of a plating task are improved, and productivity can be improved because a variation in the plating speed attributable to a reduction of the concentration of plating metal can be reduced.

What is claimed is:

1. A lead-zirconate-titanate (PZT) amorphous alloy plating solution, comprising:

a Pb precursor, a Zr precursor, a Ti precursor, and at least one of a reducing agent, a complexing agent, a stabilizer, an organic acid, and an amide-series compound, wherein 10~50 parts by weight of the Zr precursor and 5~30 parts by weight of the Ti precursor are included based on 100 parts by weight of the Pb precursor, and wherein the reducing agent comprises a phenolic-series compound represented by the chemical formula below:

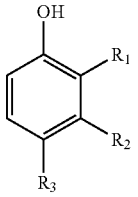

wherein, in the chemical formula above, $R_1$~$R_3$ denote a hydrogen atom, a hydroxy group, a carboxyl group, or an alkyl group having a carbon number of 1 to 4 on a straight chain or a branch.

2. A method for plating a lead-zirconate-titanate (PZT) amorphous alloy, comprising:

preparing a PZT amorphous alloy plating solution comprising a Pb precursor, a Zr precursor, and a Ti precursor; and dipping an electrode into the prepared PZT amorphous alloy plating solution and performing plating using an electric current, wherein preparing the PZT amorphous alloy plating solution comprises:

fabricating a metal powder aqueous solution having a sulfuric acid with the Pb precursor, the Zr precursor, and the Ti precursor; and including at least one of a group consisting of a reducing agent, a complexing agent, a stabilizer, an organic acid, and an amide-series compound in the metal powder aqueous solution and mixing at least one of the group and the metal powder aqueous solution.

3. The method of claim 2, further comprising:

discoloring when a concentration of lead, zirconium, and titanium included in the PZT amorphous alloy plating solution becomes a specific concentration or less after performing the plating; and supplementing the PZT amorphous alloy plating solution with the Pb precursor, the Zr precursor, and the Ti precursor.

4. The method of claim 2, wherein fabricating the metal powder aqueous solution further comprises including the sulfuric acid in 10~50 parts by weight of the Zr precursor and 5~30 parts by weight of the Ti precursor based on 100 parts by weight of the Pb precursor.

5. The method of claim 2, wherein the reducing agent comprises a phenolic-series compound represented by the chemical formula below:

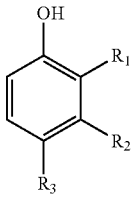

wherein, in the chemical formula above, $R_1$~$R_3$ denote a hydrogen atom, a hydroxy group, a carboxyl group, or an alkyl group having a carbon number of 1 to 4 on a straight chain or a branch.

6. The method of claim 2, wherein performing the plating comprises performing the plating using an electric current density of 3~20.0 A/dm$^2$ at a temperature of 10~30° C.

* * * * *